United States Patent [19]

Starrett

[11] 4,024,988

[45] May 24, 1977

[54] SAFETY CLOSURE ASSEMBLY FOR AN AEROSOL CONTAINER

[75] Inventor: Rupert M. Starrett, Stratford, Conn.

[73] Assignee: The Risdon Manufacturing Company, Naugatuck, Conn.

[22] Filed: Oct. 28, 1975

[21] Appl. No.: 626,038

[52] U.S. Cl. ..... 222/153; 222/402.11

[51] Int. Cl.[2] ..... B65D 83/14

[58] Field of Search ..... 222/153, 182, 402.11

[56] References Cited

UNITED STATES PATENTS

| | | | |
|---|---|---|---|
| 3,484,023 | 12/1969 | Meshberg | 222/402.11 |
| 3,722,748 | 3/1973 | Wakeman et al. | 222/153 X |
| 3,779,427 | 12/1973 | Ewald | 222/402.11 X |
| 3,894,665 | 7/1975 | Swenson | 222/402.11 |

*Primary Examiner*—Drayton E. Hoffman
*Assistant Examiner*—Charles A. Marmor
*Attorney, Agent, or Firm*—St. Onge Mayers Steward & Reens

[57] ABSTRACT

A safety closure assembly is disclosed comprising an overcap rotatably mounted on and substantially enclosing the valve end of an aerosol container, having a valve actuating tab with a spray orifice through which the container contents are discharged when the tab is depressed. A keying element associated with the tab functions to prevent its depression under certain conditions. A collar member is provided for association with the overcap, the collar member being non-rotatably mountable on the valved end of the container and having a shelf forming a blocking position, a lock-out spring which is resiliently flexible in a direction parallel to the container axis, and an upstanding catch formed on the lock-out spring. The valve actuating tab is normally disabled from operating the valve by interference of its keying element with the free end of a C-shaped ring. The ring is supported by the collar and its free end is normally urged between the keying element and the blocking portion of the collar. The ring is resiliently distortable in a plane perpendicular to the container axis and has a leg projecting in that plane which is engaged by an internal abutment in the overcap upon rotation of the latter to bend the free end of the ring outwardly away from the container axis, whereby to remove it from interfering relation with the tab keying element.

5 Claims, 10 Drawing Figures

Fig. 1.
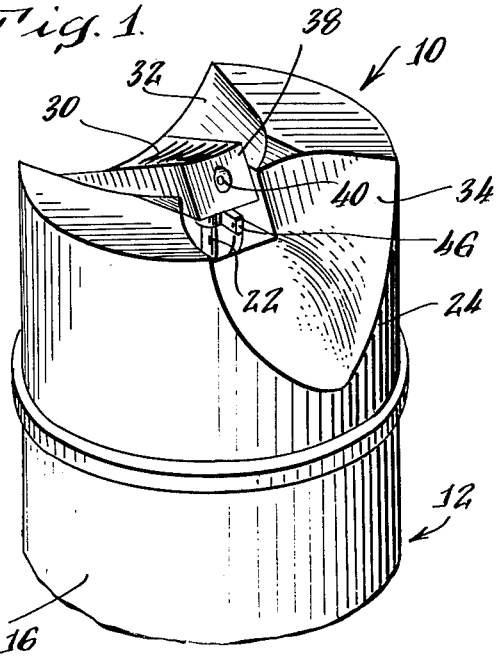
Fig. 2.
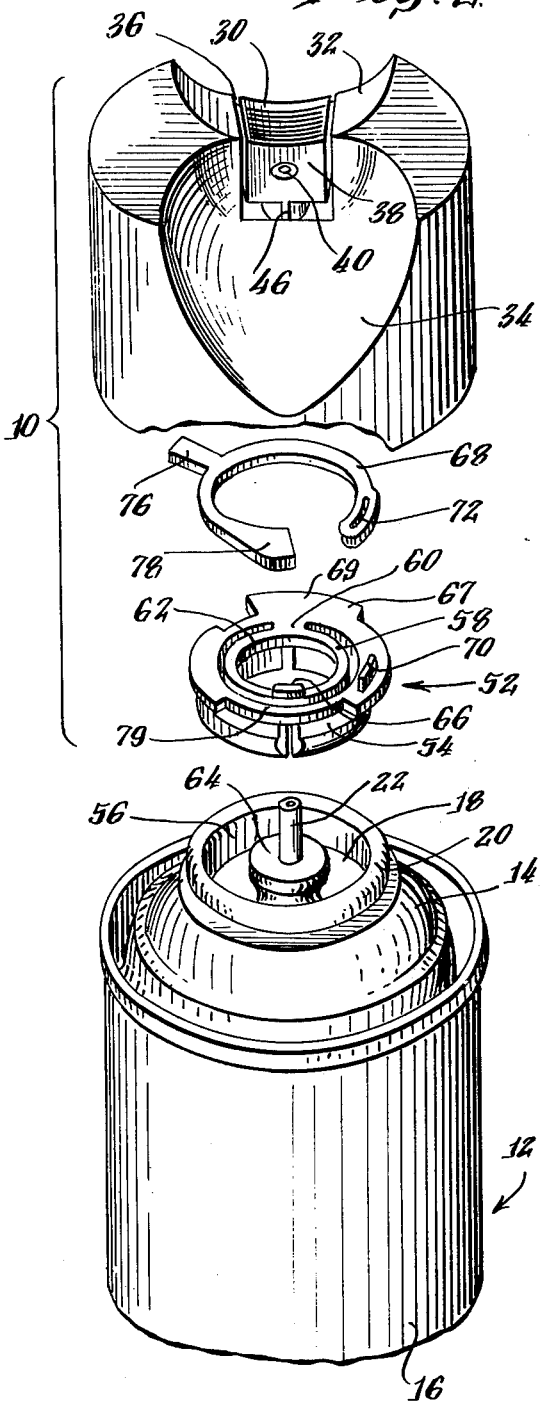
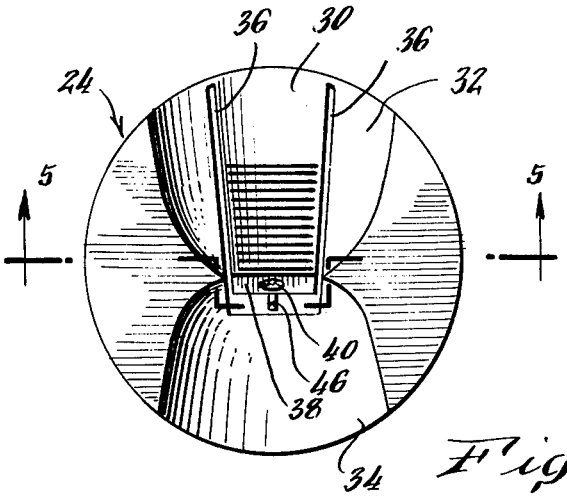
Fig. 3.
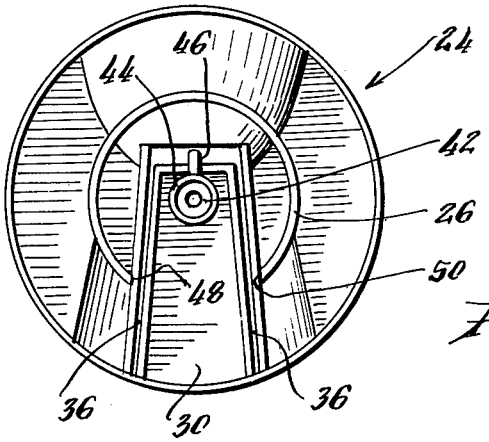
Fig. 4.

SAFETY CLOSURE ASSEMBLY FOR AN AEROSOL CONTAINER

BACKGROUND OF THE INVENTION

1. Field of the Invention

The present invention relates to a safety closure assembly for enclosing an aerosol container that is equipped with a vertically acting dispensing valve operated through a valve stem which projects axially outwardly from one end of the container. The safety closure assembly is further intended to selectively permit and prevent operation of the dispensing valve.

Aerosol containers commonly store fluid consumer products for use, when desired, in the home. Some such products are, however, potentially dangerous if misused. For example, certain pesticides, paints, disinfectants, lubricants,and household cleaners are corrosive or poisonous and, thus, can injure human health if ingested or sprayed on the skin or in the eyes. Moreover, the containers which hold such products are often stored at places in the home where small children and other unauthorized users have or can gain access to them.

Therefore, it is beneficial to package products such as these in aerosol containers having closure assemblies which deter or prevent a small child or other unauthorized user from dispensing the container's contents. Nevertheless, such closure assemblies should be relatively easy to operate by an adult when it is actually necessary to dispense contents of the container. Further, it is desirable that such closure assemblies automatically reset themseleves after use so that they cannot inadvertantly be left in operative condition.

2. Description of the Prior Art

Various types of closure assemblies for aerosol containers, such as those described above, have been proposed which can be rendered inoperative to dispense the container's contents. One such assembly is disclosed in U.S. Pat. No. 3,828,982 (Steigerwald) and includes a horizontally biased slide, disposed within an actuator overcap and accessible through the overcap side wall. The slide defines an opening through which an actuator hub can pass to permit a user to depress and operate the dispenser valve stem. The opening is normally positioned eccentrically with respect to the actuator hub to prevent depression. Sequential movement of the slide and depression of the actuator is required to dispense product by simultaneous use of the thumb and index finger of the user's hand.

U.S. Pat. No. 3,860,149 (Hagianis) discloses a childproof actuator that includes an actuator button having a finger adapted to engage the blocking portion of a collar which rests on the container valve pedestal. The button may be rotated from this "off" position to an "on" position where the finger does not engage the collar blocking portion, thus permitting the button to be depressed. U.S. Pat. No. 3,749,286 (Douglas) is directed to an actuator assembly having a slideable, forked locking member mounted to wedge between the valve actuator and the container. However, neither the Hagianis nor Douglas Patents disclose and actuator assembly which automatically resets to a valve disabling position after use.

U.S. Pat. No. 3,722,748 (Wakeman et al.), assigned to the assignee of the present invention, discloses a childsafe actuator overcap which includes a collar having an keying slot and a valve actuator having a complimentary keying element. The keying slot and element are aligned by visible indexing arrangement to render the dispenser valve operative.

Still other designs for childproof actuators are disclosed in U.S. Pat. Nos. 3,848,778 (Meshberg); 3,786,968 (Ewald); 3,760,988 (Ostrowsky); and 3,622,052 (Gach) and 3,924,782 (Starrett). The Starrett Patent is assigned to the assignee of the present invention.

SUMMARY OF THE INVENTION

In a preferred embodiment, to be described below in detail, the safety closure assembly of the present invention encloses one end of an aerosol container equipped with a vertically acting dispensing valve which is operated through an axially outwardly projecting valve actuating stem. This safety closure assembly is designed to selectively operate the dispensing valve through the valve actuating stem when the closure is placed in operative condition by performance of a programmed sequence of functions, and to be automatically reset after each operation of the dispensing valve, thereby disabling itself until again manually returned to operative condition.

The safety closure assembly includes an overcap member mounted on and substantially enclosing the valved end of the container of rotation relative to it. The overcap member is formed with a depressable valve actuating tab, a keying element associated with the tab, and a depending, peripherally interrupted skirt having parallel abutment surfaces in its side wall which define an axially extending gap or slot. A collar member is nonrotatively mounted on the container surrounding the valve stem. This collar includes a blocking shelf portion, a lock-out leaf spring cantilevered from one side of the collar member to flex parallel to the axis of the container, and an upstanding catch formed at the free end of the lock-out spring. A separate interrupted or C-shaped latch ring is secured parallel to the blocking shelf of the collar, one end of the ring being secured to the collar, the opposite free end being resiliently outwardly movable in the plane of the ring from a normal valve disabling position in which it is interposed between the overcap keying element and the collar member blocking shelf. Moreover, the interrupted ring is formed with a leg or bending lever which projects in the plane of the ring into the overcap skirt gap for contact by the aforesaid abutment surfaces upon rotation of the cap.

Rotation of the overcap relative to the container cause expansion of the interrupted ring through interaction of an abutment surface with the lever to move the free end of the ring out of valve disabling position between the keying element and the blocking shelf. When so moved, the free end of the ring is engaged by the lock-out spring catch to be latched in valve enabling position. Rotation of the overcap member in the opposite direction centers the keying element directly over the upstanding catch where it may then be depressed, permitting the actuator tab to operate the dispensing valve through the valve actuating stem. Depression, however, also depresses the lock-out spring to unlatch the catch engagement with the free end of the interrupted ring so that it is again urged to the valve disabling position. Thus, the closure assembly is automatically reset to prevent later operation without first "arming" the latching ring as described above.

Since a programmed sequence of functions must be performed before the safety closure assembly is capable of operating the dispensing valve in the aerosol container, chances of a small child or other unauthorixed user gaining access to the container's contents are minimized. In particular, the valve enabling sequence of operations is difficult for a small child to recognize and then coordinate properly. However, the steps may be performed relatively easily by an adult. Moreover, since this safety closure assembly automatically resets to a valve disabling condition after each use, an adult user cannot forget to turn the container off.

All operative components of the safety closure assembly are contained inside and are covered by the overcap member and thus cannot be easily tampered with. In addition, no separate removable blocking components are used. Therefore, no components may be lost or neglected to be replaced.

Accordingly, it is an object of the present invention to provide a safety closure assembly for an aerosol container which is placed in condition to operate the container's dispenser valve after performance of a programmed sequence of steps, and which is rendered inoperative automatically after each use of the dispenser valve.

Other objects, aspects, and advantages of the present invention will be pointed out in, or will be understood from, the following detailed description of the preferred embodiments provided below in conjunction with the accompanying drawings.

BRIEF DESCRIPTION OF THE DRAWINGS

FIG. 1 is a partial, perspective view of the safety closure assembly of the present invention installed on the valved end of an aerosol container.

FIG. 2 is an exploded perspective view of the safety closure assembly showing its various components in detail.

FIG. 3 is a top plan view of the overcap member of this safety closure assembly and of the container.

FIG. 4 is a bottom plan view of the overcap member.

DETAILED DESCRIPTION OF THE PREFERRED EMBODIMENT

Figure 5:
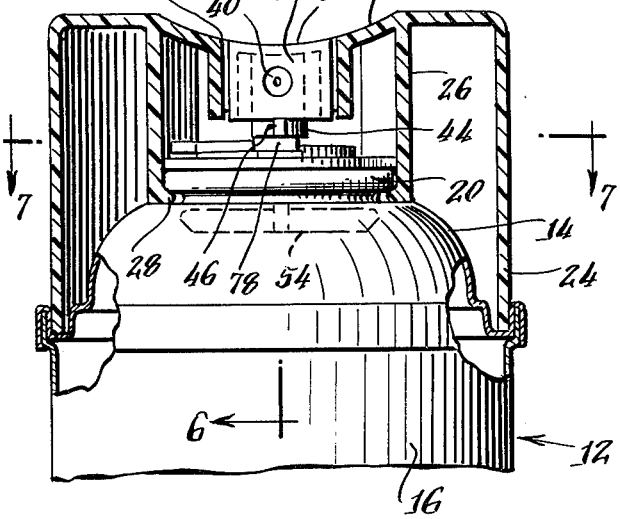
FIG. 5 is a vertical cross-sectional view taken through discontinuous plane 5—5 in FIG. 3, illustrating attachment of the overcap member to the aerosol container.

FIGS. 1 and 2 illustrate the preferred embodiment of the safety closure assembly of the present invention, generally indicated at 10, installed on an aerosol container 12 which stores a fluid product under pressure to be dispensed when needed.

The container 12 includes a dome-shaped top 14 fixed to a cylindrical body 16 in conventional fashion. An open mouth is defined at the apex of the dome-shaped top 14 and receives a valve cup 18 and associated valve (not shown) which close the container. The lip of valve cup 18 is crimped to the mouth to form an annular rim 20 which provides a convenient means for mounting the safety closure assembly.

Valve cup 18 may be equipped with any standard type of vertically acting aerosol valve assembly which includes a valve stem 22 that projects axially outwardly of container 12. The valve stem is spring biased in to its outer position. When pressed inwardly, the stem 22 opens the dispensing valve mounted inside the container to permit dispensing of the container's fluid contents in a well-known manner.

Figure 6:
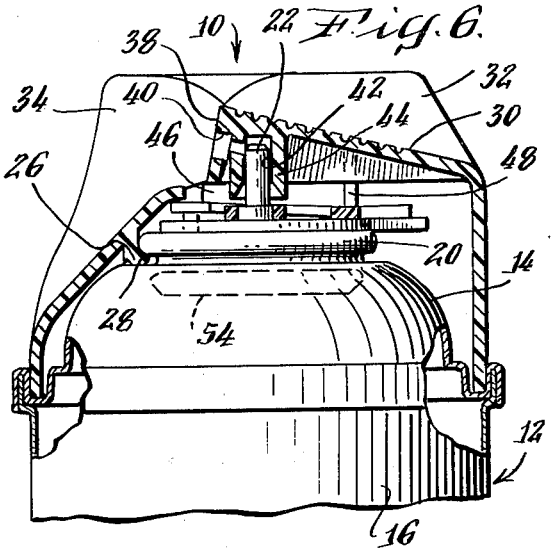
FIG. 6 is a vertical cross-sectional view taken through plane 6—6 in FIG. 5 looking toward the left.

The closure assembly 10 includes an injection molded plastic actuator overcap member 24, mounted on and substantially enclosing the valved end of the container 12. As illustrated in FIGS. 4 through 6 overcap 24 is formed with a depending, inner cylindrical skirt 26 that has an inwardly directed annular retaining lip 28 positioned at its lower margin to snap over rim 20 and hold the overcap on the container. This mounting arrangement permits relative rotation of the overcap and container.

Overcap member 24 is molded with a valve actuator 30 in the form of a tab resiliently hinged thereto, and is slotted at 36 to define the actuator tab 30 with the hinge located at the juncture of the tab with the overcap sidewall. The molding process is designed so that the tab 30 assumes a slightly elevated position shown in FIG. 1. The overcap member is also molded with a curved depression 32 in which a finger of the operator's hand may be comfortably rested and guided to the valve actuator tab 30. A second curved depression 34 is also formed on the front face of overcap 24 to provide an open path for liquid dispensed from the discharge orifice.

As shown in detail in FIGS. 4 and 6, skirt 26 is interrupted in its periphery to form two opposing axially extending abutment surfaces 48, 50, which define an axially extending gap or slot into which valve actuator tab 30 may be partially depressed.

As shown in FIGS. 1 through 5, valve actuator tab 30 is formed with a front face 38 having a discharge orifice 40 that communicates internally with a chamfered valve stem socket 42 located in a depending hollow hub 44. The hub is disposed so as to be generally coaxial with valve stem 22 when actuating tab 30 is depressed. A radially, outwardly directed keying element in the form of a rib 46, whose function will be described in greater detail below, is also formed on the exterior of hub 44.

Referring now to FIG. 2, the safety closure assembly 10 further includes a mechanism, mounted on container 12, which disables the dispensing valve by preventing depression of valve actuator tab 30. This mechanism includes a collar assembly 52 comprising a cylindricl collar member 54 which is sized to be received over the valve stem and to be press fitted into the annular cavity 56 defined by the upstanding annular rim 20 of crimped valve cup 18 and container dome 14. In this fashion, collar member 54 is non-rotatively mounted relative to container 12.

Collar assembly 52 further comprises a circular lock-out leaf spring 58 cantilevered by a hinged tab 60 on the inner surface of collar member 54. The central hole 62 in lock-out spring 58 is large enough to pass freely downwardly over pedestal 64 which serves to internally mount the valve (not shown) in the valve cup 18. An upstanding catch 66 is formed on the opposite, free side of lock-out spring 58 and, accordingly, can be displaced upwardly or downwardly parallel to the axis of container 12.

Collar member 54 is also formed with a segmented flange 67 which overlies and projects radially in peripherally stepped relation around the annular container rim 20 (FIGS. 7 through 10).

An interference member in the form of a C-shaped spring or interrupted ring 68 is mounted on collar member 54 by means of interengagement between a socket 72 and an upstanding mating pin 70 in the respective members. The opposite free end of ring 68 is thereby supported in cantilevered manner above flange 67 of collar 54. An outwardly projecting leg or bending lever 76 is formed integrally at the back of the ring, and a radially enlarged interference plate 78 is formed on its free cantilevered end. Lever 76 is positioned to project into the gap defined by abutment walls 48 and 50 when components of the closure assembly are all properly mounted on the container, and is contacted by abutment wall 48 upon rotation of cap 24.

Figure 7:
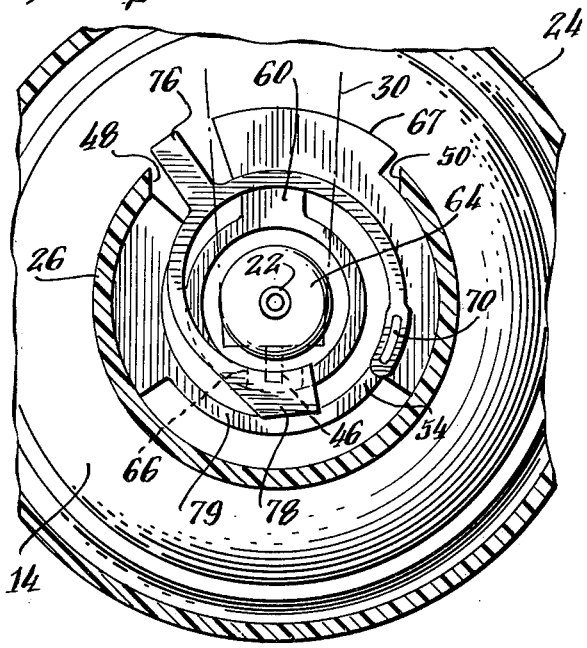
FIG. 7 is a horizontal cross-sectional view, taken through plane 7—7 in FIG. 5 looking downwardly, showing the safety closure assembly in its valve disabling condition.
Figure 8:
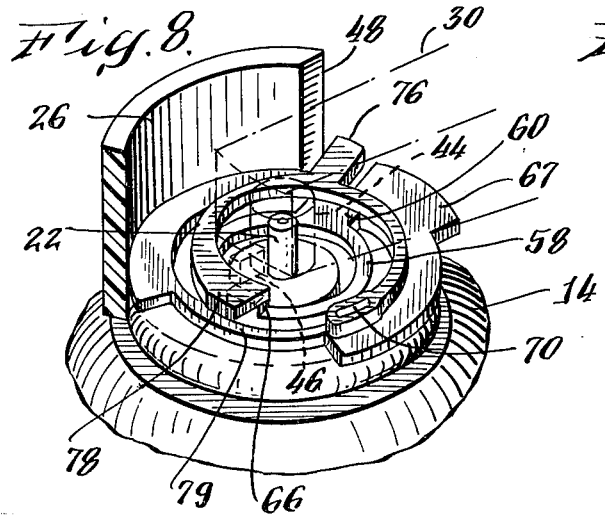
FIG. 8 is an enlarged perspective view, partly broken away to shown detail, also illustrating the safety closure assembly in its valve disabling condition.

The physical relationship and operation of the various components of this safety closure assembly 10 may be explained with reference to FIGS. 7 through 10. As shown in FIGS. 7 and 8, the interference plate 78 is dimensioned to extend over a portion of the upwardly facing surface of collar member 54 which is, then, a blocking shelf 79. Further, plate 78 is urged by the spring action of ring 68 to a valve disabling position between shelf 79 and keying element 46 of the actuator tab so that the tab may not be depressed to the degree required to operate the dispensing valve. Abutment walls 48 and 50 of skirt 26 constitute means for engaging lever 76. They also serve to limit rotation of the overcap by abutting the opposite edges of flange segment 69 of collar member 54 which projects radially into the gap of the inner skirt of the cap member.

Figure 9:
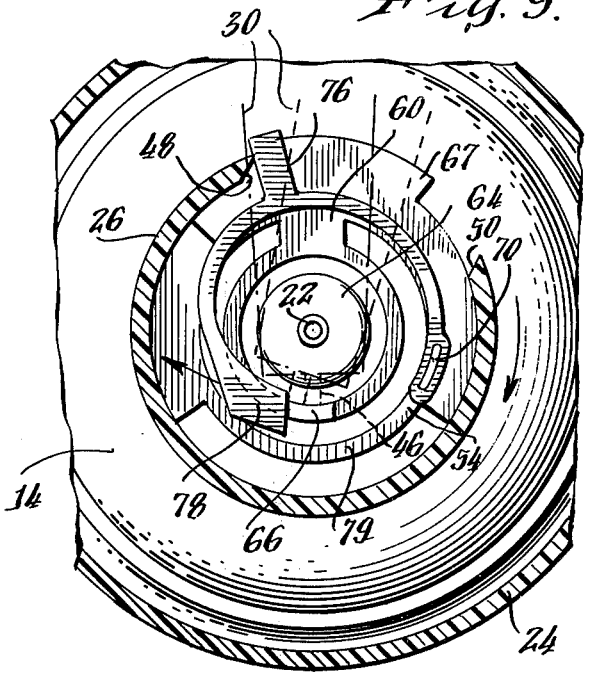
FIG. 9 is a horizontal, cross-sectional view similar to that shown in FIG. 7 illustrating the safety closure assembly in its valve enabling position.
Figure 10:
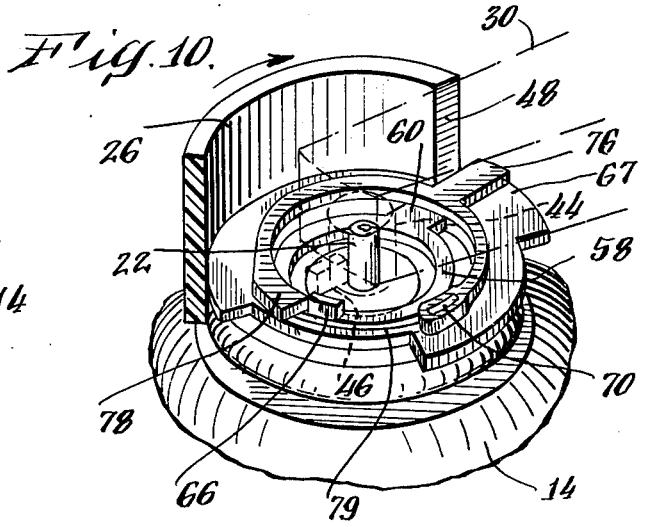
FIG. 10 is a perspective view, similar to that shown in FIG. 8, also illustrating the safety closure assembly in its valve enabling position.

To render actuator tab 30 and, hence, the dispenser valve operable, blocking plate 78 is moved to the valve enabling position shown in FIGS. 9 and 10 as follows:

Overcap 24 is rotated in a clockwise direction relative to the container as viewed from above. This causes abutment wall 48 to force lever 76 rightward, expanding ring 68 until the abutment wall engages the left edge of a flange segment 69 serving as a positive stop against further rotation. The aforesaid bending action spreads or opens the ring, thus forcing plate 78 leftward until it no longer overlies catch 66. Lock-out spring 58, being biased upwardly in the axial direction, causes catch 66 to move upwardly. Thus, when the overcap is released and blocking plate 78 attempts to return rightward under the spring action of the ring 68, it is intercepted by the elevated catch 66 and is held in armed condition.

The aerosol container may then be operated by rotating the cap in a counterclockwise direction until keying element 46 overlies catch 66 directly. This point is established by abutment of wall 50 with flange segment 69. As shown in FIG. 8, the keying element 46 is radially short enough so that it does not overlie the blocking shelf 79 of collar member 54 and thus does not inhibit depression of the actuator tab to operate the dispensing valve.

The closure assembly is automatically reset to non-operating condition as follows:

As actuator tab 30 is depressed to operate the dispensing valve, catch 66 is also depressed, disengaging it from intercepting position relative to plate 78. Thus, this end of ring 68 tries to return to its valve disabling position overlying catch 66 and shelf 79 of collar member 54 but is prevented from completely doing so at this stage by abutment of interference plate 78 with keying element 46. Subsequently, when tab 30 is released upon completion of the dispensing operation, however, and returns upwardly under the influence of the resilience of the hinged attachment to the overcap, the keying element is retracted axially above catch 66 sufficiently to permit interference plate 78 to complete its return to valve disabling position between shelf 79 and keying element 46. Subsequent attempted depression of the tab 30 is stopped by interengagement of the keying element, interference plate and collar member blocking shelf.

As can be seen from the above description, a programmed sequence of functions must be performed to place the safety closure assembly in condition to permit operation of the dispensing valve. In particular, the overcap must first be rotated in a clockwise direction relative to the container to move and lock interference plate 78 in its valve enabling position. The overcap is then rotated in a counterclockwise direction until stopped by interengagement of abutment wall 50 an the right edge of flange 67. This engagement positions the keying element over the catch 66 where the tab may be depressed to dispense the container's contents.

Moreover, each use of the safety closure assembly automaticallty resets it in inoperative, valve disabling condition.

The programmed sequence of functions is difficult for a small child to recognize and remember. Therefore, unauthorized operation is discouraged. Further, an adult need not remember to reset the safety closure to an inoperative condition after its use.

Although a specific embodiment of the present invention has been disclosed above in detail, it is to be understood that this is for purposes of illustration. Modifications may be made to the described safety closure assembly for an aerosol container by those skilled in the art in order to adapt the safety closure assembly to particular applications.

What is claimed is:

1. A safety closure assembly for an aerosol container which is equipped with a dispensing valve and an axially, outwardly projecting valve actuating stem, said safety closure assembly comprising:

A. an overcap member mountable on the valved end of the container for substantially enclosing it and being rotatable relative thereto, said overcap member having 1. valve actuating means formed with a discharge orifice and a socket opening, for receiving the valve stem, interconnected to the discharge orifice, said actuating means being movable between an elevated position and a depressed, valve-operating position,
2. a keying element, associated with said valve actuating means for movement therewith, and
3. a depending skirt having opposing, axially extending abutment surfaces, which define an axially extending slot;

B. a blocking member non-rotatably mountable on the container, located generally below and spaced from said actuating means and keying element when in their elevated position;

C. interference means mountable on the container for movement between a valve disabling position between said keying element and said blocking member to prevent depression of said valve actuator means sufficient to operate the dispensing valve, and a valve enabling position removed from between said keying element and said blocking member;

D. means for urging said interference means to the valve disabling position;, said urging means comprising an interrupted ring mounted at one end with the container and having an opposite end cantilevered theefrom to be moved perpendicularly with respect to the container axis, said interference means being mounted at said cantilevered ring end;

E. means for moving said interference means to the valve enabling position by rotation of said overcap member relative to the container in one direction, said moving means comprising a lever fixed to said interrupted ring, projecting away therefrom into said slot, operatively associated with at least one of said abutment surfaces, whereby rotation of said overcap relative to the container laterally moves said lever, pulling said ring to move said interference means to the valve enabling position; and F. lock-out and reset means 1. for holding said interference means in the valve enabling position prior to operation of the dispensing valve by said valve actuating means, and
2. for resetting said interference means by permiting it to return to the valve disabling position under the influence of said urging means after the dispensing valve is operated by said valve actuator means.

2. The safety closure assembly as claimed in claim 1 wherein said overcap further comprises means for urging said actuating means and keying element to the elevated position; wherein said interference means is movable in a direction generally perpendicular to said container axis between the valve disabling and enabling positions; and wherein said lock-out and reset means comprises:

A. a leaf spring mounted at one side with the container and having an opposite side cantilevered therefrom to be moved generally parallel to the container axis; and B. an upstanding catch mounted at said cantilevered leaf spring side, said interference means overlying said catch when in the valve disabling position and laterally engaging said catch when moved to the valve enabling position, said keying element further overlying said catch to depress it to disengage said interference means and said catch when said valve actuator means is depressed to operate the dispensing valve.

3. The safety closure assembly as claimed in claim 2 further comprising;

means for limiting the relative rotational movement of said overcap member and the container to maintain said keying element in overlying relation to said interference means when in the valve disabling position.

4. A safety closure assembly for an aerosol container which is equipped with a dispensing valve and an axially outwardly projecting valve actuating stem, said safety closure assembly comprising:

A. an overcap mountable on the valved end of the container for substantially enclosing it and being rotatable relative thereto; said overcap member having 1. valve actuating means formed with a discharge orifice and a socket opening, for receiving the valve stem, interconnected to the discharge orifice; said actuating means being movable between an elevated position and a depressed, valve operation position;
2. a keying element associated and movable with said valve actuating means,
3. a depending skirt having opposing axially extending abutment surfaces which define an axially extending slot; and
4. means for urging said actuating means and keying element to the elevated position;

B. a collar member non-rotatably mountable on the container about the valve stem and including 1. a blocking shelf located generally below and spaced from said actuating means and keying element when in their elevated position,
2. a lock-out leaf spring having
   a. one fixed side,
   b. one free side, cantilevered from said fixed side to be moved generally parallel to the container axis, and
   c. an upstanding catch at said free side underlying said keying element; and C. an interference member including 1. an interrupted ring having
   a. an end fixed to said collar member,
   b. a free end cantilevered from said fixed end to be moved generally perpendicular to the container axis, and
   c. a ring bending lever projecting into said overcap slot, and
2. an interference plate mounted on the free end of said ring to be urged thereby to a valve disabling position between said keying element and blocking shelf, and to be moved to a valve enabling position, engaged by said catch, removed from between said keying element and blocking shelf by rotation of said cap relative to the container and resulting interaction between said ring bending lever and one of said abutment surfaces, said interference plate being disengaged from said catch by depression thereof when said keying element is depressed and being reset to valve disabling position under the influence of said ring.

5. The safety closure assembly as claimed in claim 4 wherein said collar member further comprises;

a radially outwardly projecting flange portion received in said overcap skirt slot to limit relative rotation of said overcap and the container to maintain said keying element in overlying relation to said interference plate when in the valve disabling position.

* * * * *